US008290390B2

(12) United States Patent
Kondo

(10) Patent No.: US 8,290,390 B2
(45) Date of Patent: Oct. 16, 2012

(54) IMAGE FORMING APPARATUS

(75) Inventor: Hakudai Kondo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 432 days.

(21) Appl. No.: 12/729,368

(22) Filed: Mar. 23, 2010

(65) Prior Publication Data

US 2011/0026963 A1 Feb. 3, 2011

(30) Foreign Application Priority Data

Aug. 3, 2009 (JP) ..... 2009-180762

(51) Int. Cl.
*G03G 21/20* (2006.01)
*G03G 15/00* (2006.01)

(52) U.S. Cl. ..... 399/92; 399/107

(58) Field of Classification Search ..... 399/92, 399/107

See application file for complete search history.

(56) References Cited

U.S. PATENT DOCUMENTS

| | | | | |
|---|---|---|---|---|
| 6,259,871 | B1 * | 7/2001 | Rider et al. | 399/92 |
| 7,024,129 | B2 | 4/2006 | Adachi | |
| 7,526,223 | B2 * | 4/2009 | Adachi et al. | 399/92 |
| 7,783,226 | B2 | 8/2010 | Tomatsu | |
| 2001/0033393 | A1 | 10/2001 | Adachi | |
| 2004/0228647 | A1 * | 11/2004 | Kida | 399/92 |
| 2005/0135834 | A1 * | 6/2005 | Kaiho | 399/92 |
| 2006/0072933 | A1 * | 4/2006 | Miyamoto et al. | 399/92 |
| 2007/0160382 | A1 | 7/2007 | Tomatsu | |
| 2007/0210512 | A1 | 9/2007 | Sakakibara et al. | |
| 2008/0050145 | A1 * | 2/2008 | Hanano | 399/92 |
| 2009/0175647 | A1 * | 7/2009 | Suzuki | 399/92 |

FOREIGN PATENT DOCUMENTS

| | | | |
|---|---|---|---|
| JP | 08-095474 | A | 4/1996 |
| JP | 09-222760 | A | 8/1997 |
| JP | 2000-330351 | | 11/2000 |
| JP | 2001-166650 | | 6/2001 |
| JP | 2001-255793 | | 9/2001 |
| JP | 2001-312188 | A1 | 11/2001 |
| JP | 2002-323834 | A | 11/2002 |
| JP | 2003-307894 | | 10/2003 |

(Continued)

OTHER PUBLICATIONS

JP Decision to Grant mailed Nov. 8, 2011, JP Appln. 2009-180762, English translation.

(Continued)

*Primary Examiner* — Susan Lee
(74) *Attorney, Agent, or Firm* — Banner & Witcoff, Ltd.

(57) ABSTRACT

An image forming apparatus including an image forming unit; a pair of frames that faces each other with sandwiching the image forming unit therebetween, at least one of the pair of frames including: a first frame, which is made of resin, and which forms a lower part thereof; and a second frame, which forms an upper part thereof; a duct that forms an air passageway between an outer side of the pair of frames and an inner side of the pair of frames; a fan that generates airflow in the duct; and a rib wall, which forms at least a part of the duct, and which is integrally molded with the first frame, wherein a width of the rib wall, increases from an upper end side of the first frame to a lower end side of the first frame.

9 Claims, 6 Drawing Sheets

FOREIGN PATENT DOCUMENTS

| | | | |
|---|---|---|---|
| JP | 2004-288676 | A | 10/2004 |
| JP | 2006-243749 | | 9/2006 |
| JP | 2007-148142 | A | 6/2007 |
| JP | 2007-238252 | | 9/2007 |
| JP | 2008-020809 | | 1/2008 |
| JP | 2008-129185 | A | 6/2008 |

OTHER PUBLICATIONS

JP Office Action dtd Apr. 12, 2011, JP Appln. 2009-180762, English translation.

* cited by examiner

IMAGE FORMING APPARATUS

CROSS-REFERENCE TO RELATED APPLICATIONS

This application claims priority from Japanese Patent Application No. 2009-180762 filed on Aug. 3, 2009, the entire subject matter of which is incorporated herein by reference.

TECHNICAL FIELD

The present application is relates to an image forming apparatus.

BACKGROUND

In an known image forming apparatus, a pair of frames installed at the positions facing each other in the horizontal direction so as to sandwich an image forming unit therebetween are made of resin.

Meanwhile, a frame made of resin generally has less mechanical strength (bending rigidity) as compared with a frame made of metal. Therefore, a load due to its own weight of an image forming unit or the like is exerted particularly onto a portion on the lower side of the image forming unit. Accordingly, a distortion easily occurs to the lower side of a frame made of resin. When distortion occurs to the frame, stress acts upon the image forming unit and may cause a negative effect on image formation.

SUMMARY

The present invention relates to a frame made of resin in an image forming apparatus in consideration of the above-described point, and in particular, it is an object of the present invention to provide a configuration suitable for an image forming apparatus.

DETAILED DESCRIPTION

<General Overview>

Figure 1:
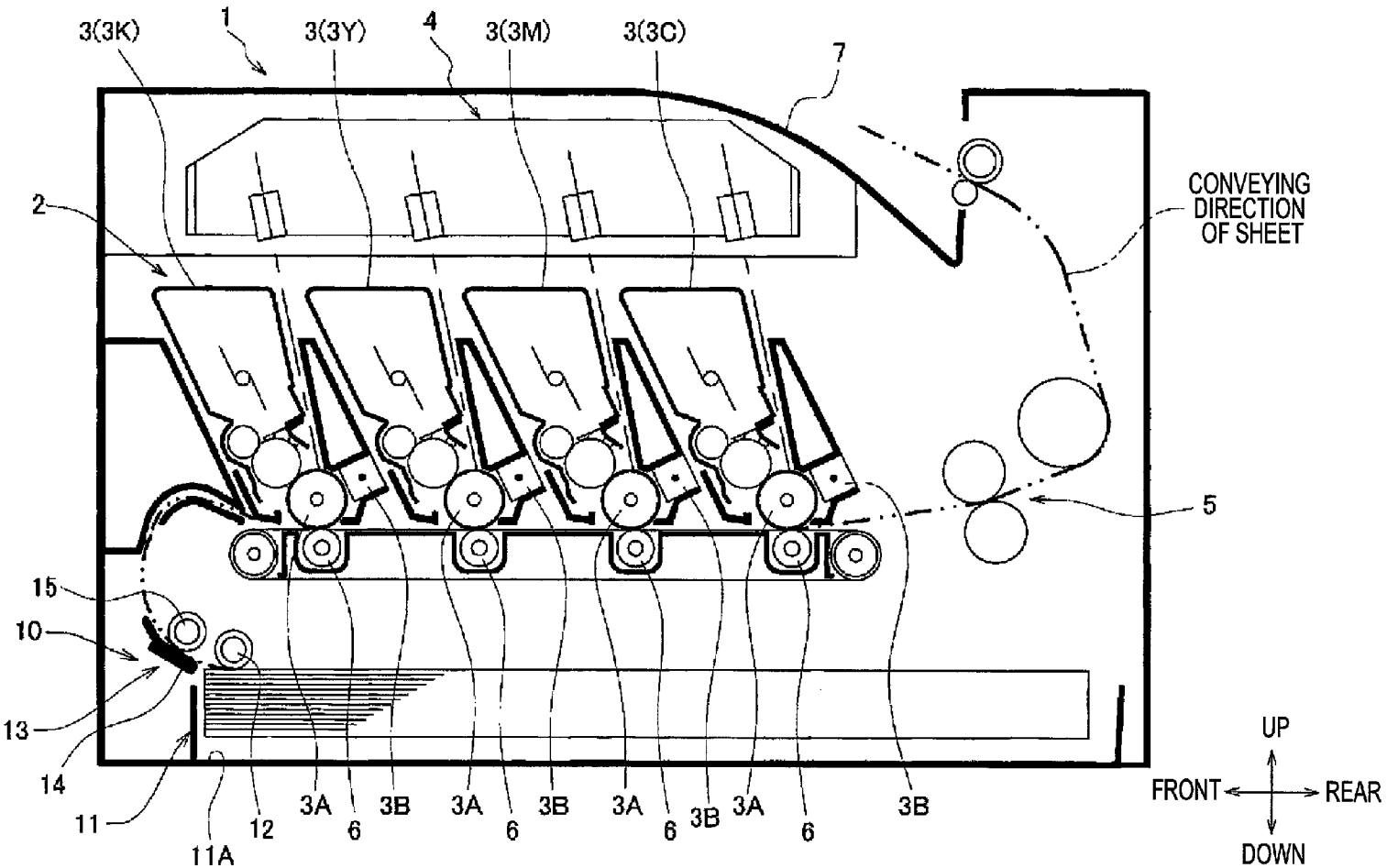
FIG. 1 is a schematic diagram corresponding to the central cross section in a front-rear direction of an image forming apparatus according to an embodiment of the present invention.

In view of above, according to one exemplary embodiment of the invention, an image forming apparatus (1) comprising an image forming unit (3) that forms an image on a sheet; a pair of frames (20, 30) that faces each other with sandwiching the image forming unit (3) therebetween, at least one of the pair of frames comprising: a first frame (21, 31), which is made of resin, and which forms a lower part thereof; and a second frame (22, 32), which forms an upper part thereof; a duct (51) that forms an air passageway (50) between an outer side of the pair of frames (20, 30) and an inner side of the pair of frames (20, 30); a rib wall (53C, 53D, 53E), which forms at least a part of the duct (51), and which is integrally molded with the first frame (21, 31), wherein a width of the rib wall (53C, 53D, 53E) increases from an upper end side of the first frame to a lower end side of the first frame (21, 31)

A load due to its own weight of the image forming unit (3) is in a direction from the upper side to the lower side. However, in the present invention, a width of the rib walls (53C, 53D, 53E) increasing from the upper end side to the lower end side of the first frame (21) is integrally molded with the first frame (21). Accordingly, the rib walls (53C, 53D, 53E) function as reinforcing members for the first frame (21).

Accordingly, in the present invention, it is possible to improve the mechanical strength of the first frame (21) by effective use of the rib walls (53C, 53D, 53E) composing at least a part of the duct (53) as reinforcing members without providing members exclusively for reinforcement. Therefore, a configuration suitable for the image forming apparatus can be obtained.

Incidentally, symbols in parentheses of the above-described respective units and the like are one example showing a correspondent relationship with concrete units and the like described in an embodiment which will be described later. The present invention is not limited to the concrete units and the like denoted by the symbols in parentheses of the above-described respective means and the like.

<Exemplary Embodiment>

In the exemplary embodiment, an image forming apparatus according to the present invention is applied to an image forming apparatus of an electro-photographic system. Hereinafter, an embodiment of the present invention will be described with reference to the drawings.

As shown in FIG. 1, an image forming apparatus 1 includes an image forming unit 2 and a sheet feeder 10. The image forming unit 2 is image forming means for forming (printing) images on sheets, OHP sheets, or the like (hereinafter, referred to as sheets), and the sheet feeder 10 is sheet feeding means for feeding sheets to the image forming unit 2.

Further, the image forming unit 2 includes process cartridges 3 (as one example of an image forming unit), an exposure device 4, a fixing device 5, and the like. The image forming unit 2 is a direct tandem system in which a plurality of (in the exemplary embodiment, four) process cartridges 3K to 3C are discretely installed along a conveying direction of sheets, and a plurality of types of developer images are directly transferred onto a sheet.

Photosensitive drums 3A on which developer images are carried, and chargers 3B that charge the photosensitive drums 3A, and the like are housed in the respective process cartridges 3K to 3C. Note that, the exposure device 4 is exposure means of a type that a laser beam is scanned in the axial direction of the photosensitive drum 3A, and the charger 3B is scorotron-type charging means utilizing corona discharge from a charged wire (not shown) extending in a direction parallel to the axial direction of the photosensitive drum 3A.

Further, the sheet feeder 10 separates sheets disposed in the end part in its stacking direction (in the exemplary embodiment, the upper most end in the up-down direction) among a plurality of sheets placed in a stacked state on a placing part 11A of a sheet feeding tray 11 one by one, and the sheet feeder convey and feed them to the image forming unit 2. Incidentally, the sheet feeding tray 11 is mountable and dismountable with respect to an apparatus main body (a main body frame or a case) with which the image forming unit 2 and other components are assembled.

Then, the sheet feeder 10 includes a pickup roller 12 and a separation mechanism 13. The pickup roller 12 touches a sheet, which is placed on the placing part 11A and disposed at the upper most end, and rotates to feed sheets. The separation mechanism 13 separates a plurality of sheets fed by the pickup roller 12 to feed them to the image forming unit 2.

Incidentally, the separation mechanism 13 includes a separating pad 14, a separating roller 15 and the like. The separating pad 14 touches a sheet fed by the pickup roller 12 to apply a predetermined conveying resistance to the sheet. The separating roller 15 rotates while pressing a sheet against the separating pad 14 to impart a conveying force to the sheet Then, the sheet conveyed from the sheet feeder 10 toward the image forming unit 2 is conveyed to a pair of registration rollers (not shown) provided on the entrance side of the image forming unit 2, and the sheet is conveyed to the photosensitive drum 3A after correcting the sheet obliquely passing by the pair of registration rollers.

On the other hand, the charged photosensitive drum 3A is exposed by the exposure device 4, and an electrostatic latent image is formed on its outer circumferential surface. Thereafter, a developer (powder form toner in the exemplary embodiment) is supplied to the photosensitive drum 3A, and a developer image is carried (formed) on the outer circumferential surface of the photosensitive drum 3A.

At this time, electric charges having a reverse polarity to that of the developer are applied to the transfer roller 6 installed on the opposite side of the photosensitive drum 3A so as to sandwich a sheet to be conveyed therebetween. Accordingly, the developer image carried on the photosensitive drum 3A is transferred to the sheet.

Thereafter, the developer transferred to the sheet is heated to be fixed to the sheet by the fixing device 5. The sheet on which image formation has been carried out is turned around to the upper side in its conveying direction, and is thereafter discharged to a sheet discharging tray 7 provided on the upper end surface side of the image forming apparatus 1.

In the image forming apparatus 1 according to the present embodiment, as shown in FIG. 1, the exposure device 4 is installed on the side above the process cartridges 3, and the sheet feeding tray 11 (the placing part 11A) is provided on the side under the process cartridges 3.

Figure 2:
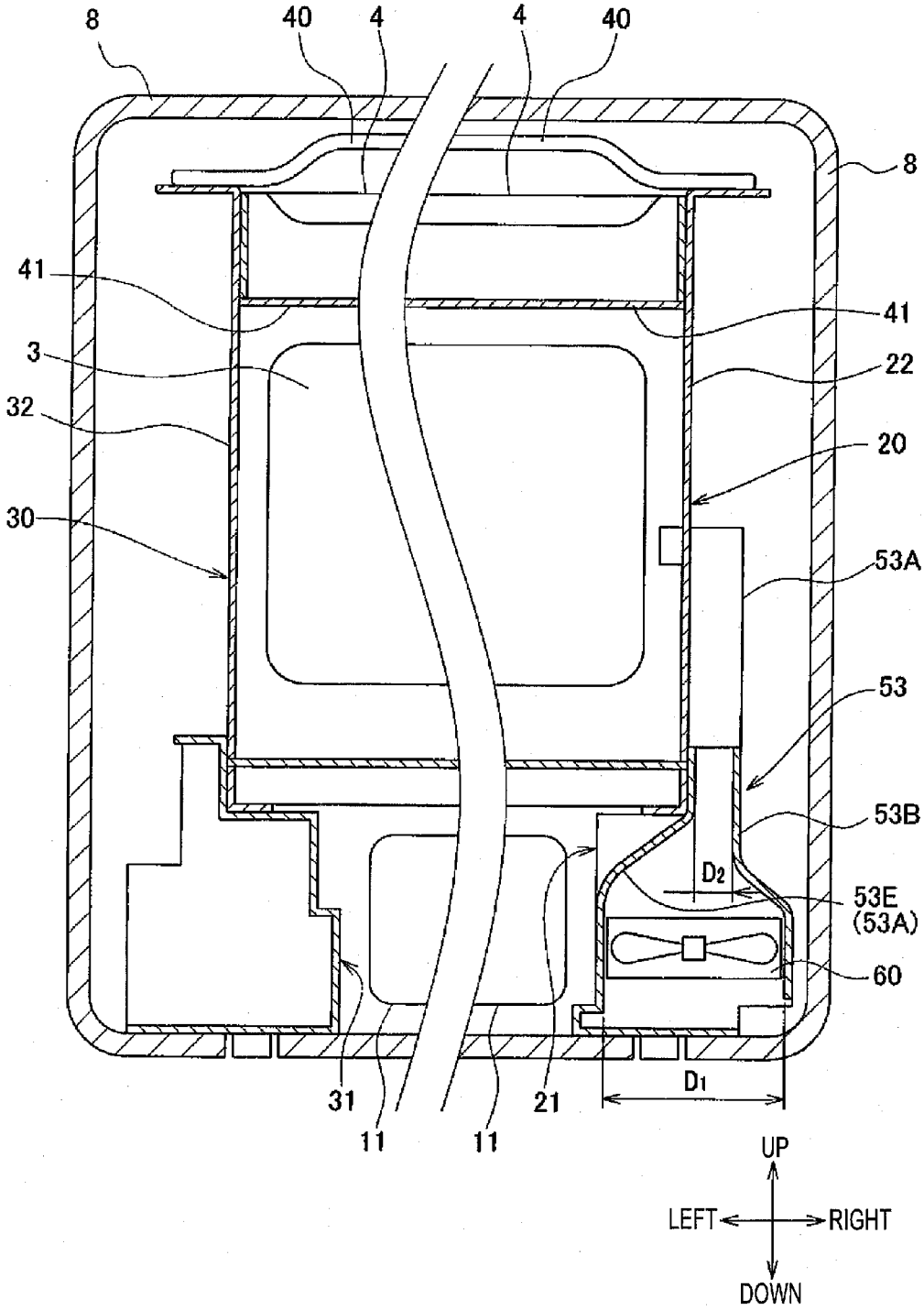
FIG. 2 is a schematic diagram corresponding to the central cross section in a right-left direction of the image forming apparatus according to the embodiment of the present invention.

On the other hand, in the exemplary embodiment), as shown in FIG. 2, a pair of frame units 20, 30 facing each other in the horizontal direction are installed on the both sides in the horizontal direction so as to sandwich the process cartridges 3 therebetween (in the right-left direction of the image forming apparatus 1 The pair of frame units 20, 30 are plate-like strength members which both vertically extend and are substantially parallel to one another.

The pair of frame units 20, 30 is covered with a case cover 8 made of resin. The case cover 8 has the external industrial design surface of the image forming apparatus 1, includes an operation panel (not shown), the sheet discharging tray 7, and the like.

Figure 3:
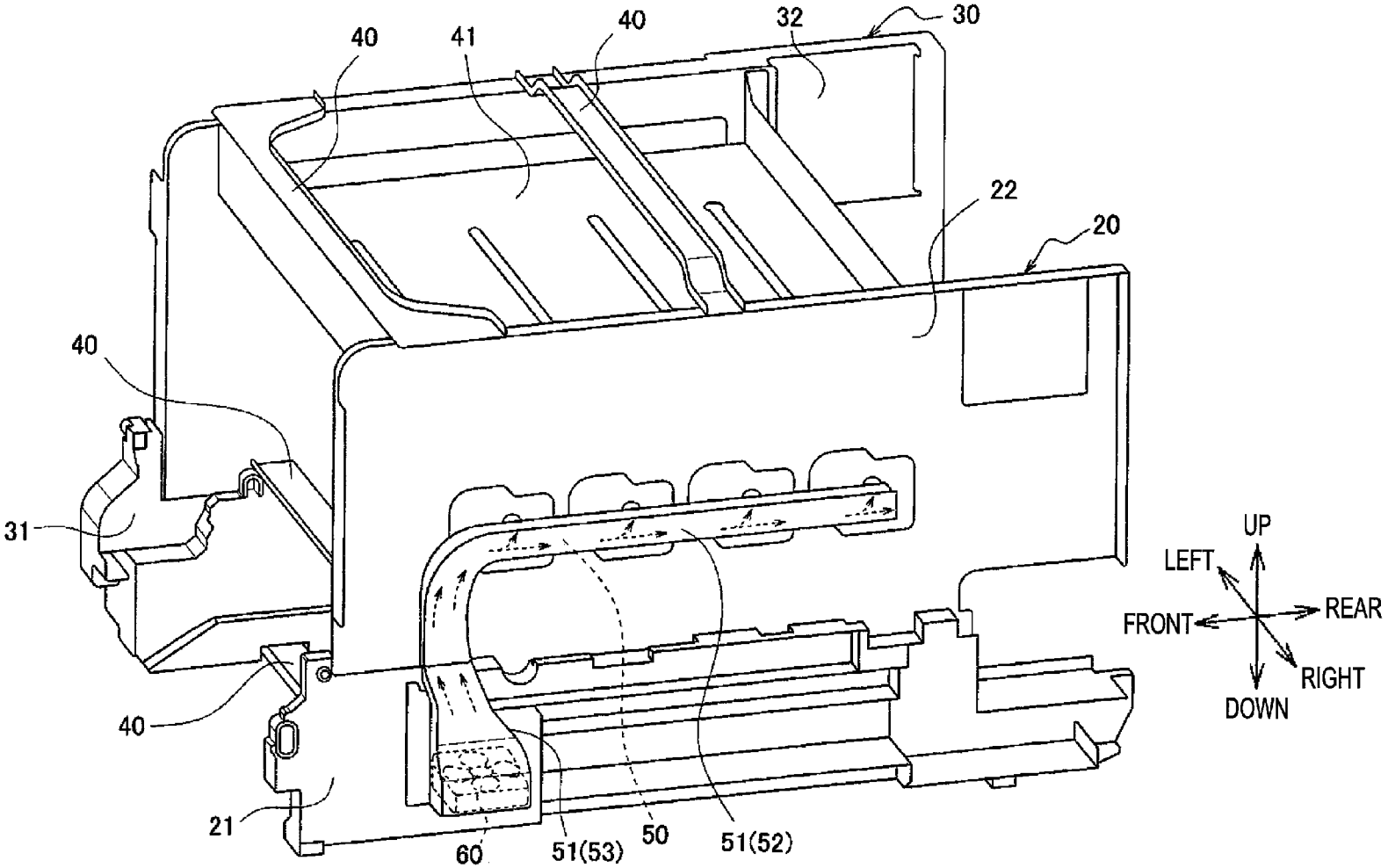
FIG. 3 is a schematic diagram showing the frame unit configuration of the image forming apparatus according to the embodiment of the present invention.

Further, as shown in FIG. 3, the pair of frame units 20, 30 is coupled via beam-like bridge members 40, a top plate 41 and the like. The beam-like bridge members 40 provided on the upper end side and the lower side. The top plate 41 installed on the upper end side. And, a rahmen structure (rigid-frame structure) frame is configured by the bridge members 40, the top plate 41, and the frame units 20, 30 (refer to FIG. 2).

The bridge members 40 are strength members coupling the pair of frame units 20, 30, and on the other hand, the top plate 41 serves as a fixing member that is to couple the pair of frame units 20, 30, and to mount and fix the exposure device 4.

Incidentally, in the exemplary embodiment in the exemplary embodiment, the top plate 41, the bridge members 40, and the frame units 20, 30 are coupled and fixed so as to be separable by mechanical fastening means such as screws, and the top plate 41 and the bridge members 40 are both made of metal such as cold rolled steel coil (SPCC).

Further, the pair of frame units 20, 30 are respectively composed of first frames 21, 31 made of resin such as ABS resin which are disposed on the lower side, and second frames 22, 32 made of metal such as SPCC which are disposed on the upper side of the first frames 21, 31.

Figure 4:
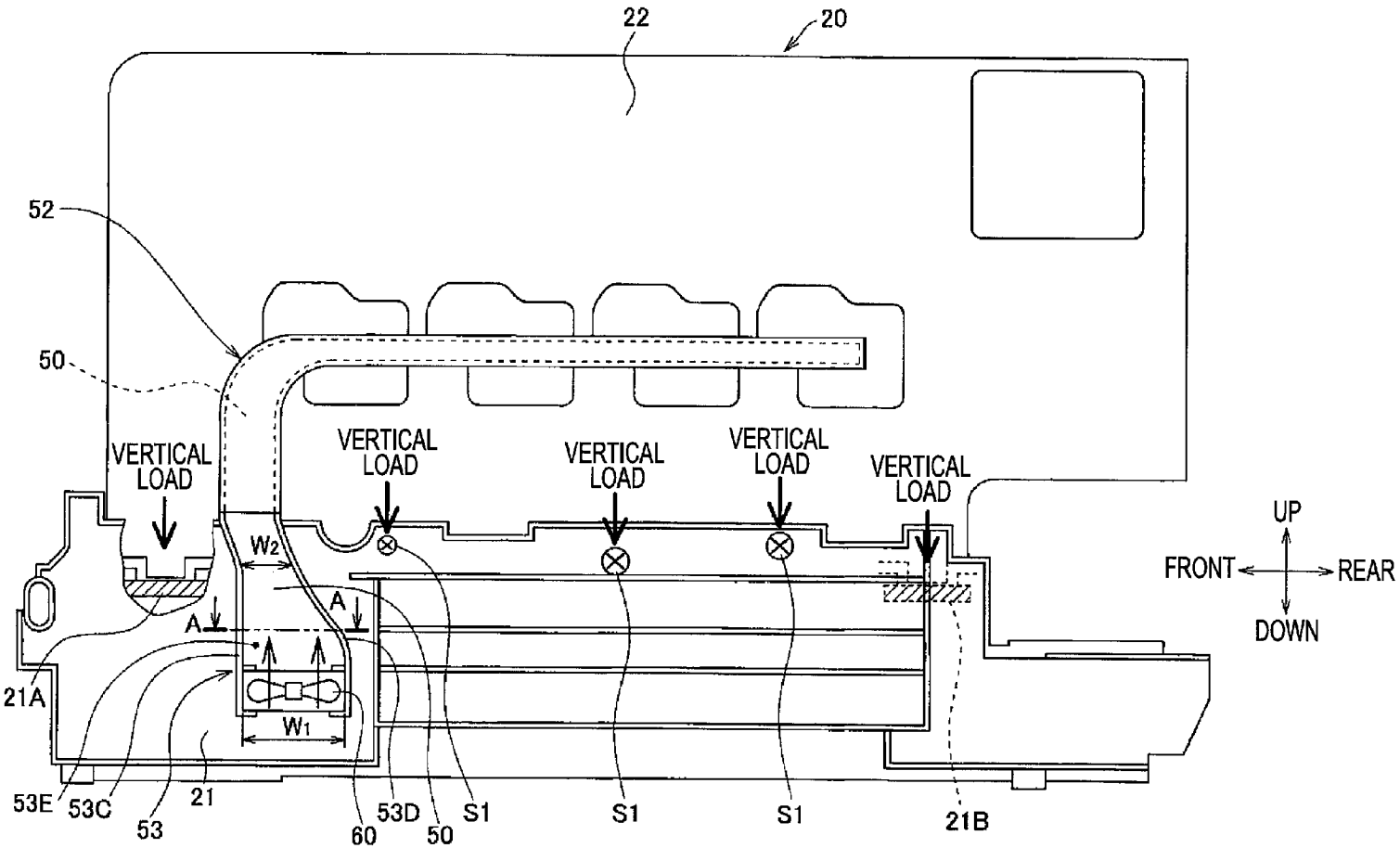
FIG. 4 is a schematic diagram showing the frame unit configuration of the image forming apparatus according to the embodiment of the present invention.

The first frames 21, 31 and the second frames 22, 32 are coupled and fixed so as to be separable by mechanical fastening means such as screws S1 at a plurality of places (three places in the exemplary embodiment) as shown in FIG. 4.

Meanwhile, the four process cartridges 3C to 3K and the exposure device 4 are held directly or indirectly by the second frames 22, 32. Accordingly, a load due to the own weight of the four process cartridges 3C to 3K and the exposure device 4 (hereinafter the load is called vertical load) is always exerted onto the first frames 21, 31 via the second frames 22, 32.

The vertical load is exerted onto the first frames 21, 31 via the screws S1 coupling the first frames 21, 31 and the second frames 22, 32, and load receiving parts 21A, 21B provided on the both end sides in the longitudinal direction of the first frames 21, 31 (in the front-rear direction of the image forming apparatus 1 in the exemplary embodiment).

In the exemplary embodiment, the load receiving parts 21A, 21B and the areas into which the screws S1 are mounted in the first frames 21, 31 are loading points receiving the vertical load. In FIG. 4, only the coupling structure of the first frame 21 and the second frame 22 in the frame unit 20 is shown. However, the coupling structure of the first frame 31 and the second frame 32 in the frame unit 30 as well has the same configuration as the frame unit 20.

The charger 3B is utilized corona discharge as described above. When a large amount of dust or the like is floating around its charged wire, the dust is attached to the charged wire and the contaminated charged wire may reduce its charging (discharging) ability.

In the exemplary embodiment, air is blown into the space in which the process cartridges 3 (in particular, the chargers 3B) are disposed in the space in the apparatus surrounded by the pair of frame units 20, 30, to blow away dust and the like floating around the charged wires, to prevent the dust from attaching to the charged wires.

In detail, as shown in FIG. 3, an air blowing duct 51 forming an air passageway 50 which is communicated with the spaces in which the chargers 3B (the charged wires) are installed, and a fan 60 that generates an airflow in the air blowing duct 51 are provided on the frame unit 20 side.

In the exemplary embodiment, the air blown from the air blowing duct 51 to the chargers 3B of the respective process cartridges 3C to 3K is circulated through the chargers 3B from the frame unit 20 side toward the frame unit 30 side along the charged wires, and is thereafter discharged to the space in the apparatus.

Incidentally, as shown in FIG. 4, the fan 60 according to the present embodiment includes an axial flow fan (refer to Japanese Industrial Standards: JIS B 0132 No. 1012 and the like) by which air passes through in its rotational axis direction), and the fan 60 sucks air from the lower side of the space in the apparatus, and blows the air into the space in the apparatus on the process cartridges 3 side.

Further, as shown in FIG. 3, the air blowing duct 51 includes a first duct part 52, and a second duct part 53. The first duct part 52 is formed into a substantially L shape that is assembled with the second frame 22. The second duct part 53 is communicated with the first duct part 52. The first duct part 52 and the second duct part 53 are coupled in an area corresponding to the upper end part of the first frame 21.

Figure 5:
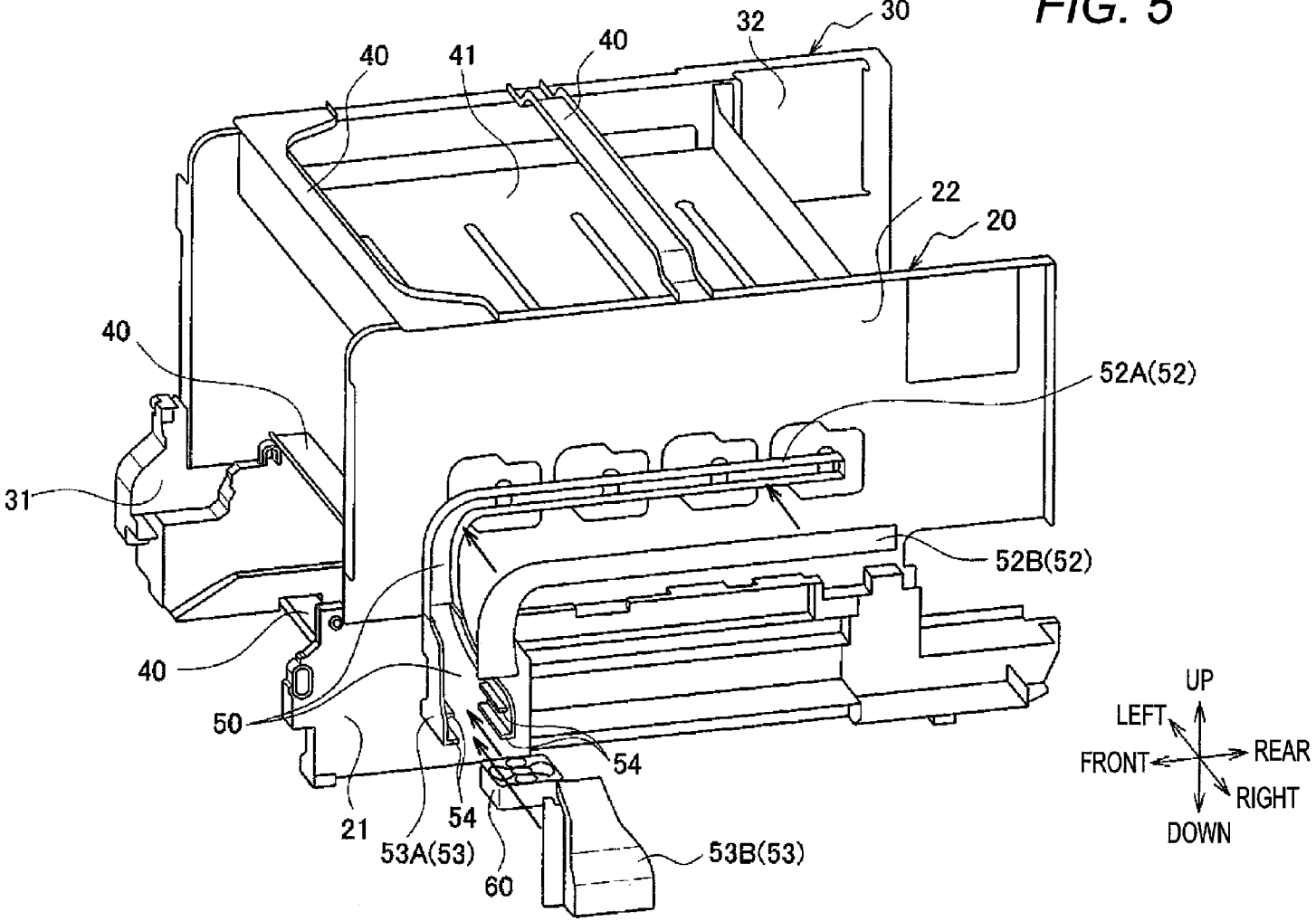
FIG. 5 is a schematic diagram showing the frame unit configuration of the image forming apparatus according to the embodiment of the present invention.

As shown in FIG. 5, the first duct part 52 includes a first duct main body 52A formed into a substantially laterally-facing U shape in section so as to open on the case cover 8 side, and a thin-film first duct cover 52B that covers the first duct main body 52A so as to close the opening side of the first duct main body 52A, and the like.

The first duct main body 52A is made of hard resin such as acrylonitrile butadiene styrene (ABS) resin, and is assembled to be fixed to the second frame 22. On the other hand, the first duct cover 52B is made of soft resin such as polyethylene terephthalate, and is bonded to the first duct main body 52A with an adhesive, a double-sided tape, or the like.

Further, the second duct part 53 includes a second duct main body 53A formed into a substantially laterally-facing U shape in section so as to open on the case cover 8 side, and a second duct cover 53B that covers the second duct main body 53A (as one example of a rib wall) so as to close the opening side of the second duct main body 53A, and the like.

Figure 6:
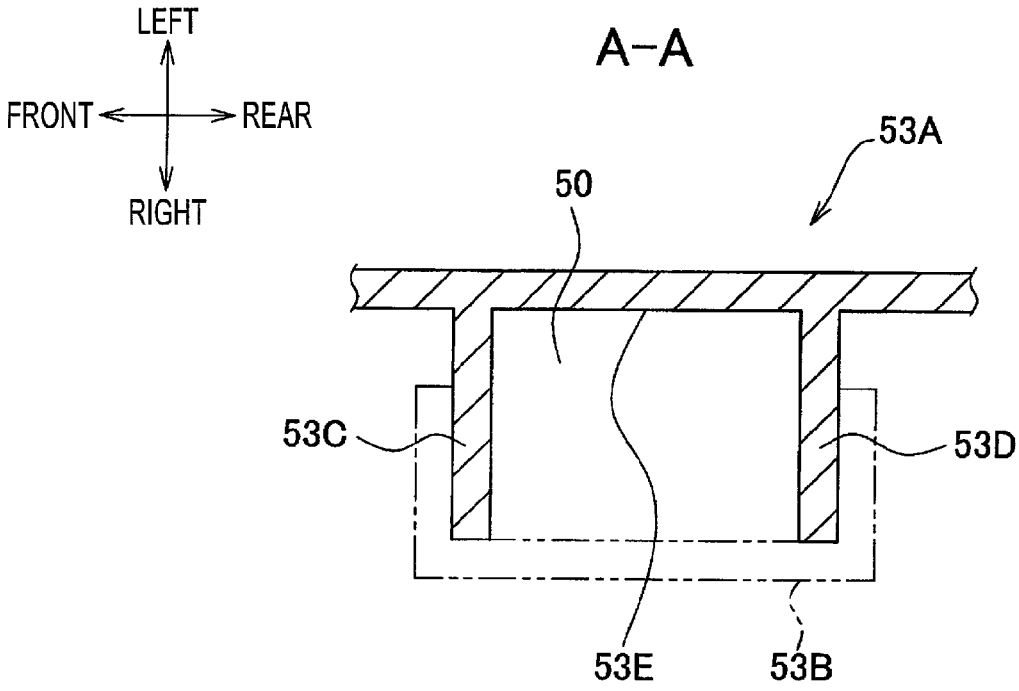
FIG. 6 is a cross-sectional diagram of FIG. 4 along the line A-A.

Then, as shown in FIGS. 4 and 6, the second duct main body 53A includes a first rib wall 53C, a second rib wall 53D, and a frame wall 53E. That is, the first rib wall 53C and the second rib wall 53D face each other so as to sandwich the air passageway 50 therebetween (refer to FIG. 6), and spread so as to be wall-like from the areas between the load receiving part 21A and the screw S1, i.e., between adjacent loading points on the upper end side of the first frame 21 to the lower end side (refer to FIG. 4).

Further, the frame wall 53E is connecting the first rib wall 53C and the second rib wall 53D. The frame wall 53E, the first rib wall 53C, and the second rib wall 53D are integrally formed at the same time of shaping the first frame 21. Then, in the exemplary embodiment, as shown in FIG. 6, a substantially U-like shape in section is configured by the first rib wall 53C, the second rib wall 53D, and the frame wall 53E.

Further, as shown in FIG. 2, the frame wall 53E is disposed on the sheet feeding tray 11 (process cartridges 3) side with respect to the second duct cover 53B. Then, the projection dimensions of the first rib wall 53C and the second rib wall 53D from the frame wall 53E to the case cover 8 (the second duct cover 53B) side are set such that a projection dimension D1 on the lower side is greater than a projection dimension D2 on the upper side. Incidentally, the projecting direction of the first rib wall 53C and the second rib wall 53D corresponds to the facing direction of the pair of frame units 20, 30.

In the exemplary embodiment, the sheet feeding tray 11 is installed in the area corresponding to the first frames 21, 31. Accordingly, the areas on the lower side of the first rib wall 53C and the second rib wall 53D are made to come close to the sheet feeding tray 11 as compared with the areas on the upper side.

Further, as shown in FIG. 4, the distance between the first rib wall 53C and the second rib wall 53D is set such that a first distance W1 on the lower side is greater than a second distance W2 on the upper side as the air passageway 50 formed by the second duct part 53 goes toward the lower side. Accordingly, its section area of the passageway becomes greater. Then, in the exemplary embodiment, the fan 60 is installed on the lower side in the air passageway 50 formed by the second duct part 53.

As shown in FIG. 5, protrusions 54 which project from a face of the rib wall to form the strip-shaped wall and extend in the projecting direction of the first rib wall 53C and the second rib wall 53D (facing direction). The strip-shaped protrusions 54 are integrally molded with the inner wall faces facing each other in the lower end sides of the first rib wall 53C and the second rib wall 53D. The fan 60 is held in the second duct part 53 so as to be sandwiched by the two protrusions 54 from the upper and lower directions.

Further, the second duct cover 53B is removable with respect to the second duct main body 53A by locking means (not shown) utilizing elastic deformation. In a state in which the second duct cover 53B is assembled with the second duct main body 53A, as shown in FIG. 6, the second duct cover 53B is partially overlapped with the first rib wall 53C and the second rib wall 53D.

The fan 60 is fixed in the second duct part 53 in a state in which its vertical displacement is regulated by the protrusions 54, and its horizontal displacement is regulated by the wall face of the second duct main body 53A and the wall face of the second duct cover 53B.

In the exemplary embodiment, when the second duct cover 53B is detached from the second duct main body 53A, it is possible to easily detach the fan 60 from the second duct part 53.

A vertical load due to the own weight of the process cartridges 3 and the like is in a direction from the upper side to the lower side. However, in the exemplary embodiment, the first rib wall 53C and second rib wall 53D spreading from the upper end side to the lower end side of the first frame 21 are integrally molded with the first frame 21. Accordingly, the first rib wall 53C and the second rib wall 53D function as reinforcing members for the first frame 21.

Accordingly, in the exemplary embodiment, it is possible to improve the mechanical strength of the first frame 21 by effective use of the first rib wall 53C and the second rib wall 53D composing the part of the second duct part 53 as reinforcing members without providing members exclusively for reinforcement. Therefore, a configuration suitable for the image forming apparatus 1 can be obtained.

Incidentally, the first duct part 52 is assembled with the second frame 22 made of metal, the first duct part 52 is not expected to function as a reinforcing member in the exemplary embodiment. However, the first duct part 52 may be caused to function as a reinforcing member of the second frame 22.

In the exemplary embodiment, the air blowing duct 51 is not provided on the frame unit 30 side, the configuration is made such that rib walls serving as a part of an air blowing duct are not provided to the first frame 31. However, the first frame 31 as well is made of resin of the same quality of the first frame 21. Accordingly, in the exemplary embodiment, a rib walls exclusively for reinforcement are provided to the first frame 31.

Further, in the exemplary embodiment, the second duct main body 53A includes the first rib wall 53C and the second rib wall 53D facing each other so as to sandwich the air passageway 50 therebetween, and the frame wall 53E forming the wall connecting the first rib wall 53C and the second rib wall 53D.

In the exemplary embodiments described above, a U-like shape in section is configured by the first rib wall 53C, the second rib wall 53D, and the frame wall 53E as shown in FIG.

6 when viewed from above. Accordingly it is possible to further improve the mechanical strength of the first frame 21.

Further, in the exemplary embodiment, the first distance W1 on the lower side is greater than the second distance W2 on the upper side, in the distance between the first rib wall 53C and the second rib wall 53D, and additionally, the fan 60 is installed on the lower side in the air passageway 50. Accordingly, the fan 60 is made to be housed in the second duct part 53, which makes it possible to effectively use the space (air passageway) in the second duct part 53.

Meanwhile, a high dimensional accuracy is required for the areas in the frame units 20, 30 to which the process cartridges 3 are mounted. However, even if a dimensional accuracy in the area in the frame units 20, 30 to which the sheet feeding tray 11 is mounted is a lower dimensional accuracy as compared with the areas to which the process cartridges 3 are mounted, there is little practical trouble.

Accordingly, as in the exemplary embodiment, a mounting area in which the placing part 11A (i.e. the sheet feeding tray 11), on which sheets to be conveyed toward the process cartridges 3 are placed, is set in an area corresponding to the first frame 21. Accordingly, the parts (the first frames 21, 31) of the frame units 20, 30 can be made of resin without causing any practical problem.

The second frames 22, 32 are formed by processing metal working such as press working onto the metal plates. Accordingly, the dimensional accuracy in the second frames 22, 32 is a higher dimensional accuracy as compared with the first frames 21, 31 which are the resin molded components. On the other hand, because the second frames 22, 32 are made of metal, it is difficult to form the second frames 22, 32 into complicated shapes as compared with the first frames 21, 31 which are the resin molded components.

In the exemplary embodiment, while the first frames 21, 31 are made of resin to be capable of easily achieving their complicated shapes, the mechanical strength of the first frames 21, 31 is complemented by providing the first rib wall 53C and the like. On the other hand, the second frames 22, 32 are made of metal, to obtain the high dimensional accuracy and high mechanical strength thereof.

Meanwhile, the process cartridges 3 forms an image on a sheet. Accordingly, its dimension in a width direction is generally greater than a width dimension of the sheet. On the other hand, it is sufficient for the placing part 11A (the sheet feeding tray 11) on which sheets are placed to have a size necessary for housing sheets. Accordingly, its dimension in the width direction is generally less than a dimension in the width direction of the process cartridge 3 as shown in FIG. 2. The width direction is a direction parallel to the direction, in which the pair of frame units 20, 30 are facing each other.

On the other hand, a dimension in the width direction of the image forming apparatus 1 as a whole is determined by a dimension in the width direction of the process cartridge 3. The dimension in the width direction of the process cartridge 3 has a large dimension. Accordingly, dead spaces are generated in the areas on the lower side of the space in the apparatus, which correspond to the first frames 21, 31.

The projection dimension D1 is the dimension between the area of the first rib wall 53C and the second rib wall 53D parallel to the facing direction, i.e. the dimension in the facing direction, on the lower side, and the projection dimension D2 is the dimension in the facing direction on the upper side. The projection dimension D1 is greater the projection dimension D2. Accordingly, the above-described dead spaces can be effectively used as spaces for providing the first rib wall 53C and the second rib wall 53D therein.

If the second frames 22, 32 are made of resin such that the second frames 22, 32 has the mechanical strength that is the same as that of the second frames 22, 32 made of metal, it is necessary for the width dimension of the second frames 22, 32 to be a width dimension, which is approximately the same as dimension of the first frames 21, 31. Therefore, a dimension in the width direction of the image forming apparatus 1 as a whole becomes greater than that in the state shown in FIG. 2.

In contrast, as in the exemplary embodiment, the areas of the frame units 20, corresponding to the process cartridges 3 or the like (the second frames 22, 32) are made of metal and the areas of the frame units 20, 30 corresponding to the sheet feeding tray 11 (the first frames 21, 31) are made of resin. Then the above-described dead spaces are effectively used as spaces for providing the first rib wall 53C and the second rib wall 53D therein and securing the mechanical strength of the second frames 22, 32. Accordingly, it is possible to restrict a dimension in the width direction of the image forming apparatus 1 from becoming great.

Further, in the exemplary embodiment, the protrusions 54 which project from a face of the rib wall to form the strip-shape wall are integrally molded with the first rib wall 53C and the second rib wall 53D and the fan 60 is held by the protrusions 54, the protrusions 54 for holding the fan 60 can be utilized as reinforcing members for the first rib wall 53C and the second rib wall 53D.

Accordingly, for example, if something collides against the first rib wall 53C or the second rib wall 53D and an external force is exerted onto the first rib wall 53C or the second rib wall 53D in the time of conveying the first frame 21 or the like, it is possible to prevent the first rib wall 53C or the second rib wall 53D from being damaged.

Further, in the exemplary embodiment as shown in FIG. 4, the first rib wall 53C and the second rib wall 53D spread so as to be wall-like from the areas between the adjacent loading points, i.e. the load receiving part 21A and the screw S1 to the lower end side, the loads exerted onto the respective adjacent loading points can be received by the first rib wall 53C and the second rib wall 53D. Accordingly, the first rib wall 53C and the second rib wall 53D can be made to effectively function as reinforcing members.

(Modifications to Exemplary Embodiments)

In the above-described exemplary embodiment, the present invention is applied to a direct tandem system image forming apparatus. The application of the present invention is not limited thereto, and the present invention can be applied to an intermediate transfer system image forming apparatus, for example.

Further, in the above-described exemplary embodiment, the exposure device 4 is of a type that a laser beam is scanned. Alternatively, the exposure device 4 may be an exposure device of a type that a large number of LEDs are arrayed in the axial direction of the photosensitive drums 3A, for example.

Further, in the above-described exemplary embodiment, the second duct main body 53A includes the first rib wall 53C, the second rib wall 53D, and the frame wall 53E. Alternatively, the second duct main body 53A may be composed of, for example, only the first rib wall 53C, or only the second rib wall 53D, or only the frame wall 53E, or only two walls among the first rib wall 53C, the second rib wall 53D, and the frame wall 53E.

Further, in the above-described exemplary embodiment, a U-like shape in section is configured by the first rib wall 53C, the second rib wall 53D, and the frame wall 53E when viewed from above. Alternatively, an H-like shape in section may be configured.

Further, in the above-described exemplary embodiment, the air blowing duct 51 is provided only on the frame unit 20 side. Alternatively, the air blowing duct 51 (the second duct part 53) may be provided on the frame unit 30 side as well, and the first frame 31 may be reinforced by utilizing the rib walls composing the second duct part 53.

Further, in the above-described exemplary embodiment, the stacking part 11A (the sheet feeding tray 11) is set to be disposed in the entire area corresponding to the first frame 21. Alternatively, the stacking part 11A (the sheet feeding tray 11) may be set to be disposed in a part of the area corresponding to the first frame 21.

Further, in the above-described exemplary embodiment, the axial flow fan is used as the fan 60. Alternatively, a centrifugal multi-blade fan such as a turbofan or sirocco-fan (refer to Japanese Industrial Standards: JIS B 0132 No. 1004 and the like) or a cross flow fan (refer to JIS B 0132 No. 1017 and the like) and the like may be used.

Further, in the above-described exemplary embodiment, airflow to send air from the fan 60 to the process cartridges 3 side is generated. Alternatively, the airflow to suck air from the process cartridges 3 side may be generated.

Further, in the above-described exemplary embodiment, the present invention is applied to a color direct tandem type electro-photographic system. However, the present invention is not limited thereto.

Further, the present invention is not limited to the above-described exemplary embodiment as long as the invention meets the gist of the invention described in the claims.

What is claimed is:

1. An image forming apparatus comprising:

an image forming unit that forms an image on a sheet;

a pair of frames, the frames facing each other and sandwiching the image forming unit therebetween, at least one of the pair of frames comprising:

a first frame, which is made of resin, and which forms a lower part thereof; and a second frame, which forms an upper part thereof;

a duct that forms an air passageway between an outer side of the pair of frames and an inner side of the pair of frames;

a fan that generates airflow in the duct; and a rib wall, which forms at least a part of the duct, and which is integrally molded with the first frame, wherein a width of the rib wall increases from an upper end side of the first frame to a lower end side of the first frame.

2. The image forming apparatus according to claim 1, wherein the rib wall comprises:

a first rib wall;

a second rib wall; and a frame wall that connects the first rib wall and the second rib wall, and wherein the first rib wall and the second rib wall face each other sandwiching the air passageway therebetween.

3. The image forming apparatus according to claim 2, wherein, on a lower side of the first frame, the first rib wall is spaced apart from the second rib wall at a first distance, wherein, on an upper side of the first frame, the first rib wall is spaced apart from the second rib wall at a second distance, wherein the first distance is greater than the second distance, and wherein the fan is installed in a lower side of the duct.

4. The image forming apparatus according to claim 1, further comprising:

a placing unit, on which the sheet to be conveyed toward the image forming unit is placed, wherein the placing unit is provided in a lower side of a space between the pair of frames, and wherein the placing unit is provided in an area corresponding to the first frame.

5. The image forming apparatus according to claim 4, wherein the frames face each other in a facing direction, and wherein a first dimension, which is parallel to the facing direction, at a lower side of the rib wall, is greater than a second dimension, which is parallel to the facing direction, at an upper side of the rib wall.

6. The image forming apparatus according to claim 1, wherein the rib wall comprises protrusions, which project from a wall face of the rib wall, which extend in a facing direction of the pair of frames, and which are integrally molded with the rib wall, and wherein the fan is held by the protrusions.

7. The image forming apparatus according to claim 1, wherein the image forming unit is held by the second frame, wherein the first frame receives a load from the second frame by a plurality of loading points, and wherein the rib wall is provided between adjacent loading points of the plurality of loading points when viewed from an upper side thereof.

8. The image forming apparatus according to claim 1, wherein the duct forms an air passageway between an outer side of the first frame and an inner side of the second frame.

9. The image forming apparatus according to claim 1, wherein the duct is made of metal.

* * * * *